United States Patent [19]

Nomura

[11] Patent Number: 4,947,725

[45] Date of Patent: Aug. 14, 1990

[54] ELECTRONIC DRUM

[75] Inventor: Yoshio Nomura, Tokyo, Japan

[73] Assignee: Casio Computer Co., Ltd., Tokyo, Japan

[21] Appl. No.: 443,805

[22] Filed: Nov. 29, 1989

Related U.S. Application Data

[63] Continuation of Ser. No. 66,696, Jun. 24, 1987, abandoned.

[30] Foreign Application Priority Data

Jun. 30, 1986 [JP] Japan ..... 61-98963[U]

[51] Int. Cl.[5] ..... G10H 3/12

[52] U.S. Cl. ..... 84/723; 84/730; 84/743; 84/DIG. 24

[58] Field of Search ..... 84/723–746, 84/DIG. 24

[56] References Cited

U.S. PATENT DOCUMENTS

| | | | |
|---|---|---|---|
| 2,525,623 | 10/1950 | Somerville | 84/421 |
| 3,439,568 | 4/1965 | Griffith | 84/DIG. 12 X |
| 4,352,048 | 9/1982 | Schulze | 318/135 |
| 4,363,217 | 12/1982 | Venuti | 248/638 X |
| 4,418,598 | 12/1983 | Klynas | 84/1.04 X |
| 4,422,779 | 12/1983 | Hamaekers et al. | 267/140.1 X |
| 4,432,537 | 2/1984 | Pletsch | 248/634 X |
| 4,479,412 | 10/1984 | Klynas | 84/DIG. 12 X |
| 4,581,972 | 4/1986 | Hoshino . | |
| 4,581,973 | 4/1986 | Hoshino . | |
| 4,679,479 | 7/1987 | Koyamoto | 84/DIG. 24 X |
| 4,700,602 | 9/1987 | Bozzio | 84/DIG. 12 X |
| 4,732,070 | 3/1988 | Yamashita | 84/DIG. 12 X |
| 4,742,753 | 5/1988 | Speed | 84/414 |

*Primary Examiner*—Stanley J. Witkowski

*Attorney, Agent, or Firm*—Frishauf, Holtz, Goodman & Woodward

[57] ABSTRACT

A vibration plate and cushioning plate are arranged, as a layered structure, within a drum shell in that order as viewed from the inner bottom of the drum shell toward a batter head with a vibration sensing/electric signal producing sensor attached to the vibration plate. A cushioning member is located within the drum shell to elastically support the cushioning plate between the inner bottom surface of the drum shell and the vibration plate. The cushioning member includes an externally urging section for externally urging the vibration plate toward the drum shell and an elastic support section which, when receiving an external strike force exceeding a predetermined value, is elastically deformed toward the inner bottom surface of the drum shell.

25 Claims, 8 Drawing Sheets

ELECTRONIC DRUM

This application is a continuation of application Ser. No. 07/066,696, filed Jun. 24, 1987 and now abandoned.

BACKGROUND OF THE INVENTION

This invention relates to an electronic drum for transducing vibration, which is produced through the striking of the drum by a striking member, such as a drumstick, to an electric signal and electrically generating a predetermined musical tone corresponding to the electric signal, and in particular to an electronic drum which can positively and exactly detect vibration as produced through the striking of the drum by a striking member, such as a drumstick, so that the performer can enjoy an excellent beating "feel" on the drum.

As one of the conventional percussion instrument an electronic drum has been developed which picks up vibration produced through the striking of the drum by the drumstick as a corresponding electric signal and electrically generates a drum sound based on the picked-up electric signal. In this type of electronic drum it is important that only the vibration resulting from the beating of the drum by the drumstick be positively and exactly picked up to generate a drum sound of a level exactly in proportion to the intensity of a beat impact by the striking member, such as a drumstick, so that the performer can enjoy an excellent percussion "touch" or "feel" during performance without being considerably fatigued even when a performance is made over a longer period of time.

In this connection, U.S. Pat. Nos. 4,581,972 and 4,581,973 disclose an electronic drum in which a cushioning member and vibration plate are arranged, as a layer structure, within a shallow-bowl type drum shell in that order as viewed from the inner bottom of the drum shell toward a batter head with a sensor attached to the vibration plate. In this electronic drum, a ring-like cushioning member is attached to the outer periphery of the vibration plate and a lower annular cushioning member is attached to the outer marginal edge portion of the vibration plate. These cushioning members prevent the generation of a vibration noise resulting from the contact of the vibration plate per se with the drum shell during performance, as well as presents the transmission, to the vibration plate, of percussion noises which result from the inadvertent beating of other than the batter head by the stick. The cushioning member mounted on the vibration plate damps an external strike force on the batter head during performance, so that the performer can experience an improved "feel" or "touch" during performance.

In the aforementioned conventional electronic drum, however, the lower cushioning member as a whole is made of a uniform elastic material of a predetermined elastic property. The lower cushioning member is placed directly on the inner bottom surface of a shallow-bowl type drum shell or on a support fixed to the drum shell and, if the lower cushioning member is not exactly so formed as to have a uniform thickness, a clearance is left between a drumhead member mounted on the marginal edge portion of an upper opening of the drum shell and the cushioning member placed over the lower cushioning member with the vibration plate therebetween. As a result, it is not possible to place the aforementioned associated members as an intimately layered unit. Upon the beating of the drumhead by the striking member, such as a drumstick, under this situation, a discordant sound is generated due to a collision between the vibration plate and the cushioning member and between the vibration plate and the drumhead member. The cushioning member and lower cushioning member with the vibration plate mounted therebetween can damp a relatively light strike force acting on the drumhead member, to the extent that the performer can enjoy a better percussion "touch" without causing any beating reaction in the performer during performance. When, on the other hand, a beating force exceeding a predetermined magnitude is continuously applied to the drumhead member, the aforementioned members cannot be adequately so damped that the performer may enjoy the performance to that aforementioned extent. Since the aforementioned predetermined magnitude is lower than that on the traditional acoustic drum, the performer is more readily liable to get tired when the drum is beaten by a relatively great strike force over a relatively longer period of time.

SUMMARY OF THE INVENTION

An object of this invention is to provide an electronic drum which can positively and exactly transmit a strike force which is applied by a striking member, such as a stick, to a vibration plate and can exactly pick up only vibration resulting from the striking of the drum to generate an electric drum sound exactly corresponding to the intensity of the aforementioned strike force.

Another object of this invention is to provide an electronic drum which can positively locate vibration plate, cushioning member and drumhead member as an intimate layered unit of a simpler arrangement, at all times so as to prevent generation of any discordant sound.

Another object of this invention is to provide an electronic drum which can damp a strike force which acts upon a drumhead member during the striking of the drumhead by a striking member, such as a drumstick, to an extent nearly equal to that obtained on the traditional acoustic drum and can further alleviate a reaction force transmitted to a performer during the beating of the drumstick by the striking member than on the traditional acoustic drum, thereby enabling a better percussion sound to be obtained without the performer's getting appreciably tired than on the traditional electronic drum.

In order to attain the aforementioned object, an electronic drum is provided which comprises:

(1) a shell opened at one end and closed at the other end;

(2) a member located at the opened side of the shell so that it is struck;

(3) fixing means for fixing the member to the shell;

(4) vibration sensing/electric signal producing means mounted on the member to be struck and adapted to pick up vibration which is produced upon externally striking the member and to generate an electric signal corresponding to the vibration thus produced; and (5) cushioning member including:

(a) an externally urging section located, within the shell, between the member and a bottom surface of the shell to urge the member externally away from the opening of the shell, and (b) a cushioning section adapted to be elastically deformed to a great extent when receiving that strike force from the member to allow it to be elastically greatly displaced toward the bottom wall of the shell.

According to another embodiment of this invention an electronic drum is provided which comprises:

(1) a shell opened at one end and closed at the other end;

(2) a mounting chassis fixed at one end to be marginal edge portion of an opening of the shell, the other end portion of the mounting chassis being held within the shell;

(3) a member fitted into said mounting chassis so that it is struck;

(4) fixing means for fixing the member to the shell at the location of an opening of said shell;

(5) vibration sensing/electrical signal producing means, attached to the member and adapted to pick up vibration resulting from an external strike force on the member and to generate an electric signal corresponding to the vibration; and (6) a cushioning member including:

(a) an externally urging section located within the mounting chassis at a position nearer to the inner bottom surface of the chassis than to the member, and (b) an elastically deforming cushioning section which is greatly elastically deformed upon receiving a strike force on the first-mentioned member to allow the first-mentioned member to be greatly displaced toward the inner bottom surface of the shell.

DETAILED DESCRIPTION OF THE PREFERRED EMBODIMENTS

Figure 1:
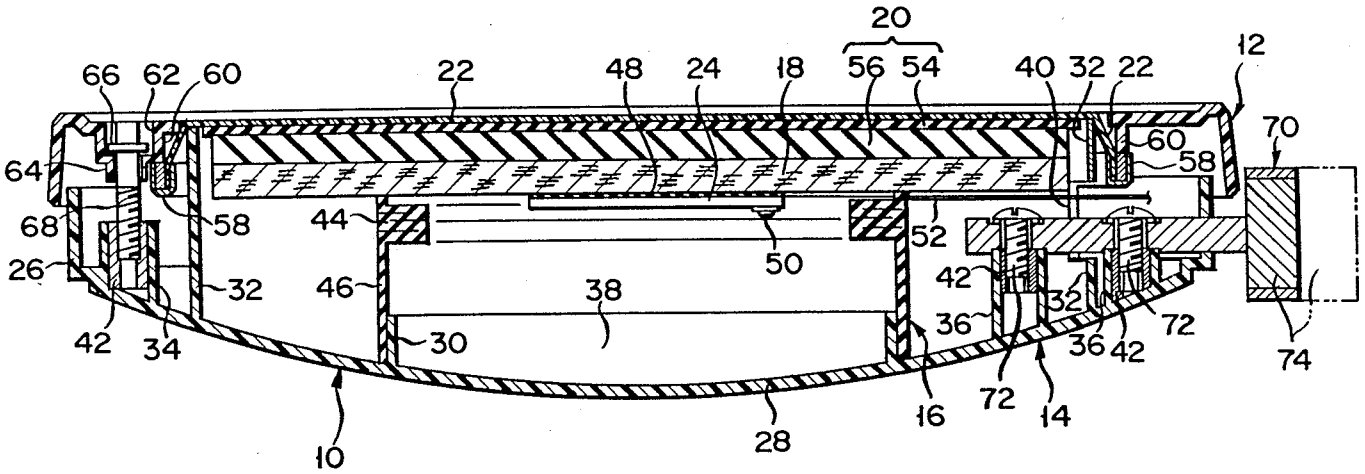
FIG. 1 is a diagrammatic cross-sectional view showing a snare drum according to a first embodiment of this invention.
Figure 2:
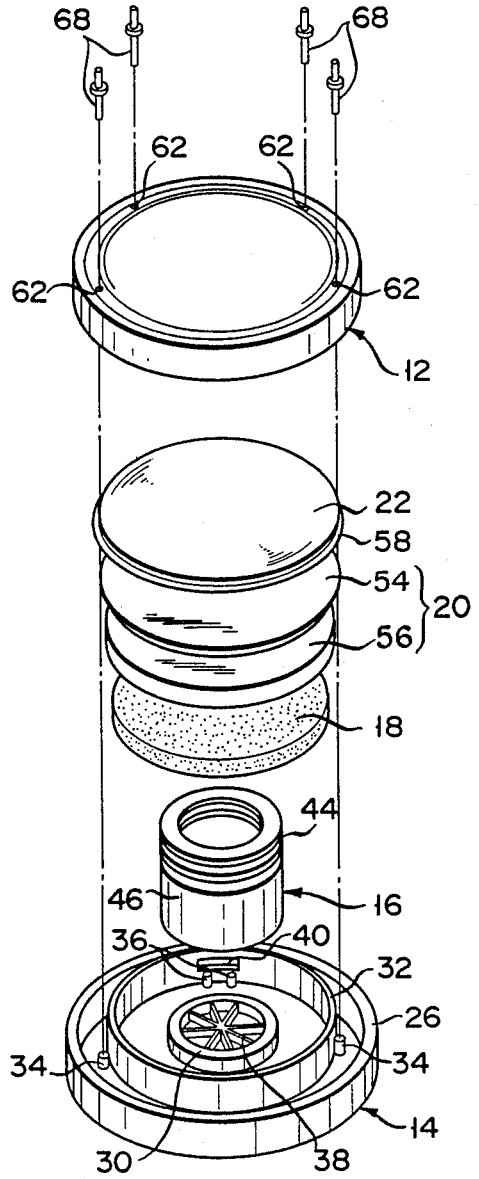
FIG. 2 is a perspective, expanded view showing the snare drum of FIG. 2.

A snare drum according to a first embodiment of this invention will be explained below with reference to the accompanying drawing sheet.

Snare drum 10 includes cushioning member 16, vibration plate 18, cushioning member 20 and drumhead member 22 within a shell which is comprised of upper and lower cases 12 and 14. When drumhead member 22 is struck by a striking member, such as a stick (not shown), vibration is produced from vibration plate 18 in accordance with the intensity of the strike force and converted to an electric signal by a vibration sensing/electric signal producing sensor 24 to electrically generate a drum sound from a drum sound generating means, not shown, on the basis of the electric signal. The associated members of the snare drum will now be explained below.

Figure 3:
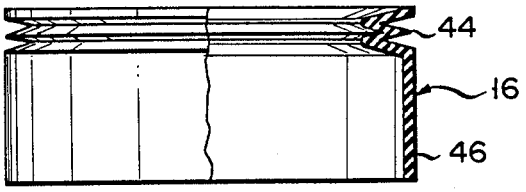
FIGS. 3 and 4 are a partial cross-sectional view and plan view, respectively, showing a cushioning member in a snare drum of FIG. 1.
Figure 4:
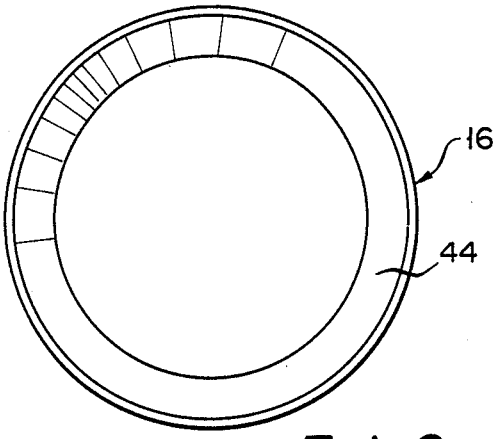
Figure 5:
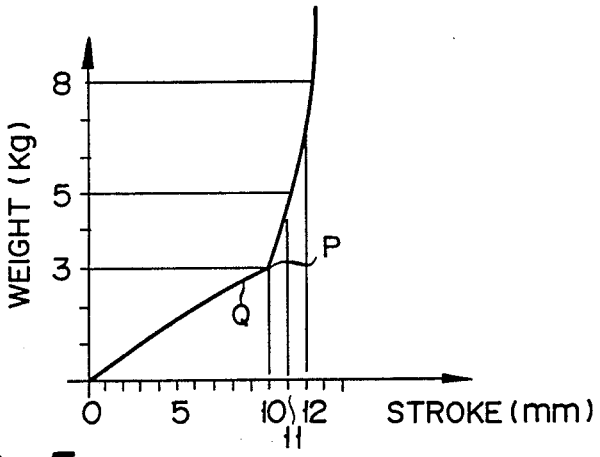
FIG. 5 is a view showing the characteristic curve of the cushioning member of FIGS. 3 and 4.

Lower case 14 is made of a synthetic resin and comprised of cylindrical, outer peripheral wall 26 and a bowl-like bottom 28. Lower case 14 has cushioning member attaching section 30, cylindrical partition wall 32, a plurality of fixing cylinders 34 and a plurality of fixing cylinders 36 on the inner surface of bottom wall 28. Cushioning member attaching section 30 is used to hold cushioning member 16 on lower case 14. Cushioning member attaching section 30 is cylindrical in configuration and lower in height and has a plurality of radial ribs 38. Vibration plate 18 and cushioning member 20 are held in a storage spacing of cylindrical partition wall 32. Partition Wall 32 is located between the outer peripheral wall 34, of lower case 14 and cushioning member attaching section 30. Partition wall 32 is higher than outer peripheral wall 26 and has support metal insertion hole 40 at a predetermined location. Four fixing cylinders 34 are equidistantly formed along outer peripheral wall 26 of lower case 14 such that they are located between outer peripheral wall 26 of the lower case 14 and partition wall 32. The fixing cylinders 34 are used to fix upper case 12 in place. Cylindrical metal piece 42 having an internal thread is fitted into respective fixing cylinder 34. Four fixing cylinders 36 are formed two inside and two outside of partition wall 32 with support metal insertion hole 40 as a reference and have cylindrical metal piece 42 fitted therein to fix support metal fitting in place, as will be set forth below. Cushioning member 16 is used to elastically support vibration plate 18 and cushioning member 20. As shown in FIGS. 3 and 4, cushioning member 16 is cylindrical in configuration and has outwardly urging bellows-like section 44 at the upper side and elastically deforming cushioning section 46 at the lower side. For this purpose, cushioning member 16 is one-piece molded from urethane rubber. Elastically deforming cushioning section 46 is quickly and elastically deformed when it receives a load exceeding a predetermined value, noting that the lower end portion of cushioning member 16 is fitted over the outer periphery of cushioning member attaching section 30. Outwardly urging bellows-like section 44 elastically urges vibration plate 18 and cushioning member 20 outwardly from inside the drum shell 12, 14 so that vibration plate 18 and cushioning plate 20 are pressed up against the rear surface of drum head member 22 to allow cushioning plate 20 to be intimately attached to vibration plate 18 and drumhead member. As a result, these members serve to prevent the generation of a discordant sound during the beating of the drumhead member 22 due to their mutual collision, because the resultant vibration is transmitted from upper case 12 to vibration plate 18. As shown in FIG. 5, cushioning member 16 is such that its stroke (displacement) along the axis of the cushioning member gradually varies, under the action of outwardly urging bellow-like section 44, in proportion to a load until that load reaches a point P from an origin O. When drumhead member 22 is stretched over the upper plate with vibration plate 18 and cushioning member 20 placed as a layered structure over cushioning member 16, the load is normally applied up to the point Q. Where the beating load applied to drumhead member 22 does not reach the point Q, cushioning member 16 is not deformed and thus vibration plate 18 is never vibrated. Where, on the other hand, the load is moved from the point Q to the point P, the outwardly urging section of cushioning member 16 is displaced from the point Q to the point P so that vibration plate 18 is not vibrated due to the load thus accommodated. When a load which is applied to cushioning plate 16 through drumhead member 22, cushioning member 20 and vibration plate 18 does not reach the point Q, sensor 24 does not pick up the vibration. The strike force which is applied by the striking member, such as the drumstick, to cushioning member 16 through drumhead member 22, cushioning plate 20 and vibration plate 18, is within a range from the point P (about 3 kg in this embodiment) to a point (a predetermined value — about 8 kg in this embodiment) at which elastically deforming cushioning section 46 of cushioning member 16 is elastically deformed along the axial direction of cushioning member 16, outwardly urging section 44 is not further compressed. Since elastically deforming cushioning section 46 has an elasticity of a predetermined level, the vibration as produced by the strike force from drumhead member 22 is nearly exactly transmitted to vibration plate 18 and hence is picked up by sensor 24. When a load as applied by the drumstick to cushioning plate 16 through drumhead 22, cushioning member 20 and vibration plate 18 exceeds a predetermined level (over 8 kg in the embodiment of FIG. 4), elastically deforming cushioning section 46 of cushioning member 16 is elastically deformed so that it is compressed along the axial direction of cushioning member 16. As a result, vibration plate 18 is displaced toward inner bottom 28 so that the strike reaction as transmitted to the performer can be alleviated.

Vibration plate 18 is vibrated in accordance with the strike force exceeding a predetermined level as applied by the drumstick to drumhead member 22, because vibration plate 18 is made of a high resonant material, such as a cork, veneer or wood, and because vibration plate 18 is located over cushioning member 16 within a storage spacing defined by partition wall 32 of lower case 14. Sensor 24 is attached by a plurality of screws 50 to the undersurface of the central portion of vibration plate 18 with pad 48 therebetween to convert the vibration of vibration plate 18 to electric signal. For this purpose, sensor 24 is made of a piezoelectric element, such as a piezoelectric element. The aforementioned electric signal is supplied by lead-in wire 52 to a predetermined electric circuit as located external to lower case 14 and then to a speaker, not shown, where it is reproduced as a drum sound. In this connection it is to be noted that pad 48 is made of a damping material, such as rubber or sponge, so that the vibration of vibration plate 18 is uniformly transmitted to sensor 24.

Cushioning plate 20 is comprised of upper cushioning rubber sheet 54 and lower cushioning rubber sheet 56 and properly damps the strike force as applied to drumhead member 24 resulting from the striking of the drumhead by the striking member. Upper cushioning rubber sheet 54 is made of an elastic material, such as urethane rubber, somewhat harder than lower cushioning rubber sheet 56, so that the performer enjoys a better beating performance on the drum 10. That is, lower cushioning rubber sheet 56 is made of a somewhat softer material, such as a relatively soft sponge, than upper cushioning rubber sheet 54 so as to properly accommodate the strike force resulting from the striking of the drumhead by the drumstick and to hence transmit the vibration to vibration plate 18. Lower and upper cushioning rubber sheets 56 and 54 of cushioning plate 20 are intimately attached as a layer structure over vibration plate 18 and located as one unit within the storage spacing defined by partition wall 32.

Drumhead member 22 is made of a polyester film in this embodiment and protects upper cushioning rubber sheet 54. Circular metal frame 58, made of aluminum, is mounted on the marginal edge portion **22*a* of drumhead member 22. Upon pressing metal frame 58 downward by upper case 12, drumhead member 22 is stretched over the underlying cushioning member 20 and thus vibration plate 18 contacts with overlying cushioning member 20 so that cushioning member 16 is urged down toward inner bottom 28 against the urging force of outwardly urging section 44 of cushioning member 16**.

Upper case 14 is substantially ring-like in configuration and is made of synthetic resin and has abutting projection 60 which, when upper case 14 is mounted on lower case, abuts against metal frame 58 to cause the metal frame to be pressed down toward the lower case 14. A plurality of bolt guides 64 are provided in predetermined places in upper case 12 and have a bolt insertion hole 62 each. Bolt (fixing means) 68, together with washer 68, is inserted into bolt insertion hole 62 and then through bolt guide 64 into internally threaded cylindrical metal piece 42 which is fitted into corresponding fixed cylinder 34 of lower case 14. Upper case 12 is attached to lower case 14 by threadably inserting the forward end of bolt 68 into internally threaded metal piece 42 of corresponding fixed cylinder 34. Here, upon the clockwise or counterclockwise rotation of bolt 68, upper case 12 is moved toward and away from inner bottom 28 of lower case 14. At the same time, metal frame 58 mounted on the outer marginal edge portion of drumhead member 22 is moved toward and away from inner bottom 28 of lower case 14 through abutting projection 60 of upper case 12. In this way it is possible to control the tension of drumhead member 22. As shown in FIG. 1, the inner wall of the outer peripheral area of upper case 12 is set greater in diameter than the outer peripheral wall of lower case 14 so that the outer peripheral surface of upper case 12 does not contact with that of lower case 14 when upper and lower cases 12 and 14 are moved relative to each other in the aforementioned fashion.

Support metal fitting 70 is mounted on lower case 70 as shown in FIG. 1 so that snare drum 10 can be connected to a support member, such as a stand. Support metal fitting 70 is inserted from outside into support metal fitting insertion hole 40 of lower case 40 and secured to lower case 14 with bolts 72 each threadably inserted into internally threaded, cylindrical metal piece 42 which in turn is fitted into respective fixing cylinder 36. Sandwiching means 74 is provided on the end of a projection of support metal fitting 70 and outside of lower case 14 so that the aforementioned support member, such as a stand, may be sandwiched in a proper location.

During the assembly of snare drum 10, the lower end portion of cushioning member 16 is fitted over cushioning member attaching section 30 of lower case 14; vibration plate 18 and cushioning member 20 as a layered structure are placed on the upper surface of cushioning member 16 and; and after drumhead member 22 has been covered by cushioning member 20, upper case 12 is secured by bolts 68 to lower case 14. Thus, the assembly operation is very simple because these associated members and elements can be mounted in proper place from over the inner bottom surface of lower case 14. Since, in particular, cushioning member 16 is comprised of elastically deforming cushioning section 46 of a cylindrical configuration and outwardly urging bellows-like section 44, vibration plate 18 and cushioning member 20 can be brought by the urging force of outwardly urging section 44 into intimate contact with drumhead member 22. As a result, it is possible to prevent any discordant sound from being generated during performance due to a collision between cushioning member 20 and vibration plate 18 and between cushioning member 20 and drumhead 22. Since, in this embodiment, vibration plate 18 and cushioning member 20 are elastically urged against drumhead member 44 by outwardly urging bellows-like section 44 which is gently movable up and down within a relatively great stroke, vibration generated through the beating of upper case 12 or drumhead member 22 by the striking member, such as a stick, is not picked up if that load acting by the strike force upon the cushioning member 16 does not reach the point Q in FIG. 5. If, on the other hand, the load is within a range from the point Q to the point P, then that vibration is accommodated by outwardly urging section 44 and never transmitted to sensor 24 on vibration plate 18. When the load acting upon cushioning member 16 through the beating of drumhead member 22 by the striking member as set out above is within a range between the point P and a predetermined point (about 8 kg) exceeding the point P, then vibration is not accommodated by outwardly urging section 44 of cushioning member 16 and is supported by elastically deforming cushioning section 46 of a predetermined rigidity, enabling it to be positively transmitted to vibration plate 18 so that vibration plate 18 is vibrated. The vibration of vibration plate 18 can exactly be picked up by sensor 24. If the load acting upon cushioning member 16 through the beating of drumhead member 22 by the striking member as set out above exceeds said predetermined point (about 8 kg), then elastically deforming cushioning section 46 is elastically greatly deformed along the axial direction of cushioning member 16, properly alleviating a reaction force against that strike force. For this reason, it is possible to positively alleviate that reaction force or shock the performer is encountered during performance. Furthermore, the tension of drumhead member 22 can readily be controlled by adjusting the tension, acting on the drumhead, simply by turning bolts 68 either clockwise or counterclockwise. In this way upper case 12 is attached to lower case 14.

Figure 6:
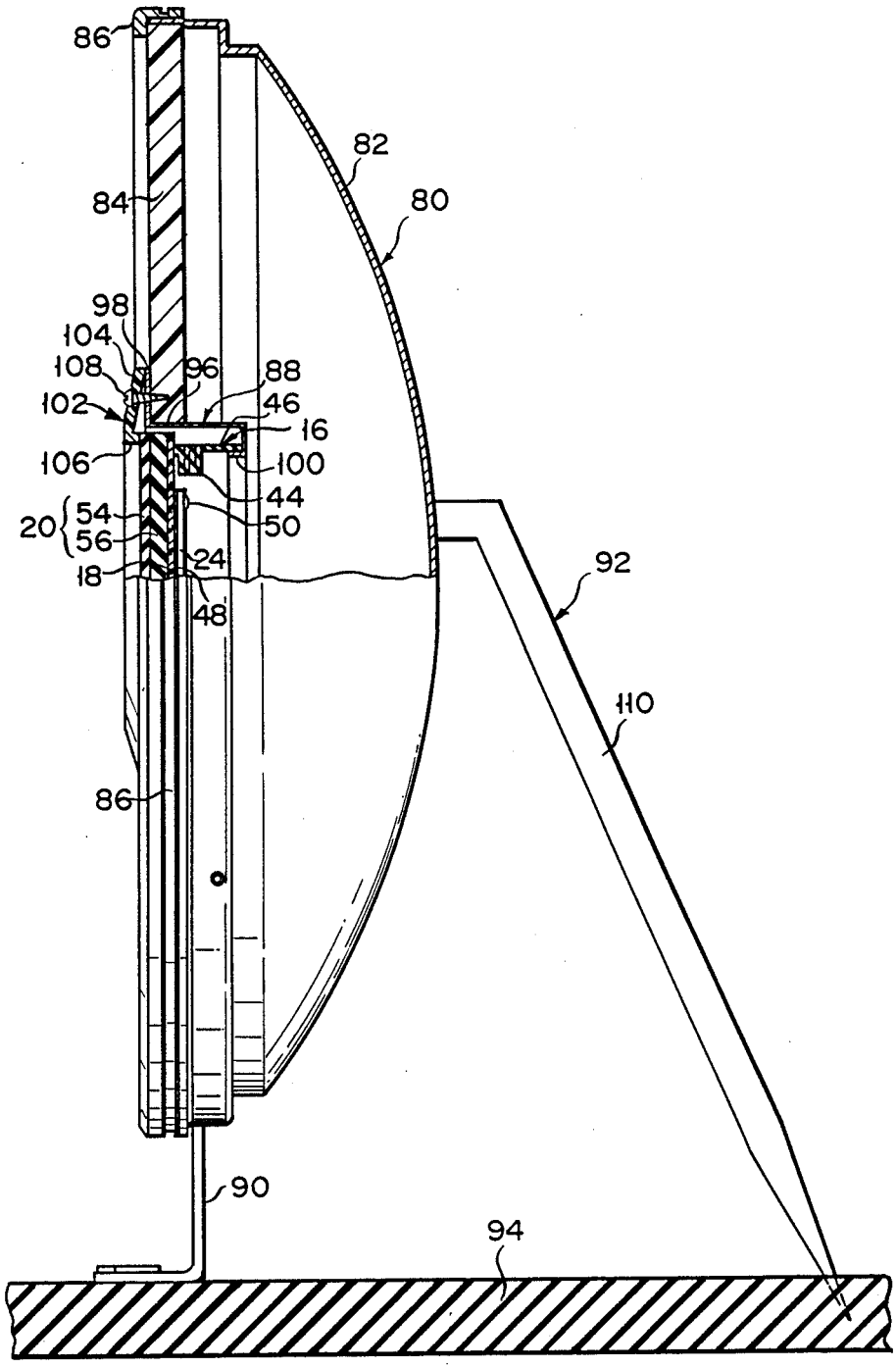
FIG. 6 is a diagrammatic, partially cross-sectional view showing a bass drum to which this invention is applied.
Figure 7:
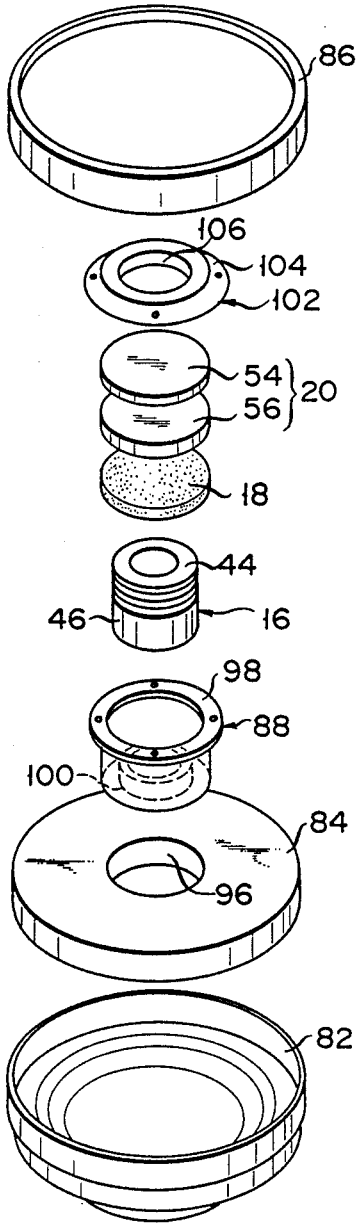
FIG. 7 is a diagrammatic, expanded view showing the bass drum of FIG. 6.

This invention will be explained below, as being applied to a bass drum, by referring to FIGS. 6 to 8 jointly. In this case, the same reference numerals are employed to designate parts or elements corresponding to those shown in FIGS. 1 to 4.

In bass drum 80, front panel 84 is mounted by outer frame 86 on the open end of rear case 82 of a substantially bowl-like configuration and mounting chassis 88 is mounted on front panel 84. The aforementioned cushioning member 16, vibration plate 18 and cushioning plate 20 are held within mounting chassis 88 and fixed as one unit to mounting chassis 88 by decorative ring 102. As shown in FIGS. 6 and 8, rear case 82 holds front panel 84 erect on rubber mat 94 by drum pedal attaching metal fitting 90 and support leg members 92, 92 and cushioning plate 20, located at the center of front panel 84, is struck by a beater which is attached to drum pedal, not shown. Front panel 84 is made of synthetic resin and has mounting hole 96 for attaching chassis 88 to the center of front panel 84. In this embodiment, outer frame 86 is made of vinyl chloride and attached to the outer peripheral area of rear case 82 at the "open end" side, thereby holding the outer peripheral surface portion of front panel 84 through the open end portion of rear case 82 and, at the same time, externally holding the marginal edge portion of the front surface of front panel 84.

Mounting chassis 88 is made of a metal and is substantially cylindrical in configuration so that it holds cushioning member 16, vibration plate 18 and cushioning plate 20 within the inner storage spacing thereof. Mounting chassis 88 has outer flange 98 at one end and cushioning member attaching section 100 at the other end portion. Mounting chassis 88 is located within mounting hole 96 of front panel 84 with outer flange 98 of mounting chassis 88 placed on front panel 84.

Cushioning member 16 is comprised of elastically deforming cushioning section 46 and outwardly urging bellows-like section 44. Elastically deforming cushioning section 46 is fitted into cushioning member attaching section 100 of mounting chassis 88. Vibration plate 18 and cushioning plate 20 are intimately attached, as a layered structure, in that order over the end face of cushioning member 16 which is located in the neighborhood of outwardly urging section 44. Vibration sensing/electric signal producing sensor 24 using a piezoelectric device is attached by screws 50 to the center of the lower surface of vibration plate 18 with pad 48 therebetween to convert the vibration of vibration plate 18 to electric signal. In the aforementioned embodiment, cushioning plate 20 is comprised of upper cushioning rubber sheet 54 and lower cushioning rubber sheet 56 and properly damps a strike force resulting from the striking of the drumhead by the beater to transmit it to vibration plate 18. Decorative ring 102 is placed on outer flange 98 of mounting chassis 88. In this embodiment, decorative ring 102 is made of synthetic resin and has flange 104 placed on outer flange 98 of mounting chassis 88 and press-down section 106 of an annular configuration extending from the inner edge of flange 104 toward attaching section 100 of mounting chassis 88. A plurality of screw insertion holes are provided in flange 104 of decorative ring 102 and in outer flange 98 of mounting chassis 88. Decorative ring 102 and mounting chassis 88 are fixed to front panel 84 by screws 108 which are threadably inserted into the aforementioned screw insertion holes. At this time, press-down section 106 of decorative ring 102 moves cushioning plate 20 toward attaching section 100 of mounting chassis 88 against an urging force of outwardly urging means 44 of cushioning member 16, so that vibration plate 18 and cushioning member 20 elastically intimately contact with each other relative to cushioning member 16.

Figure 8:
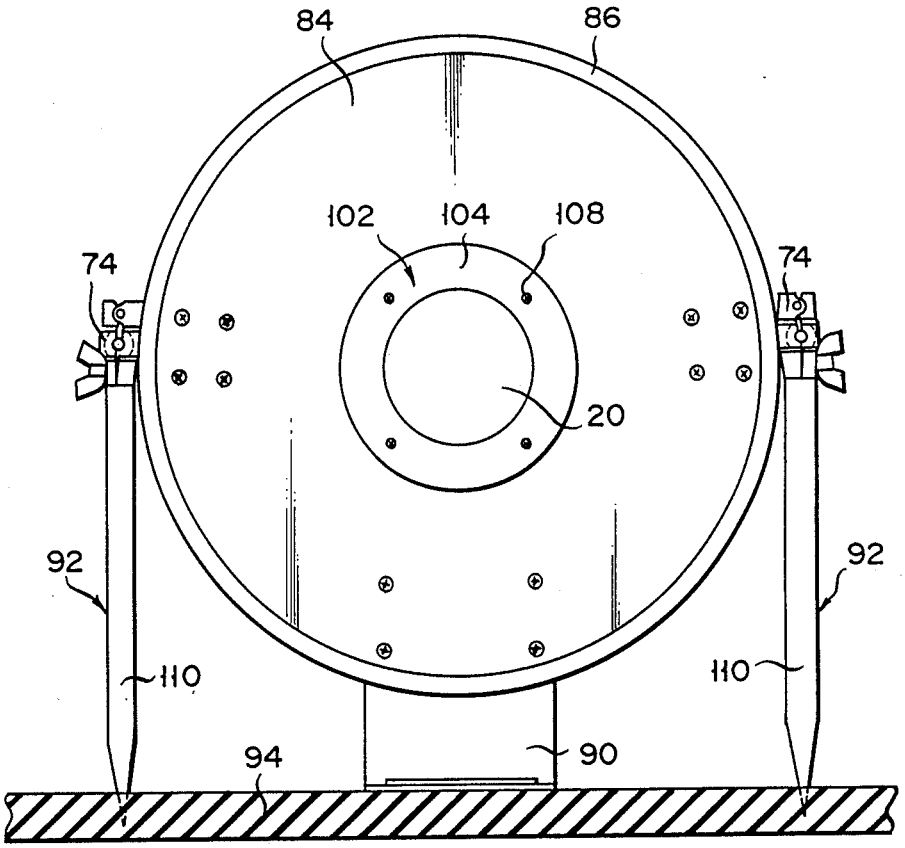
FIG. 8 is a front view showing a bass drum of FIG. 6.

As shown in FIG. 8, support leg member 92 is comprised of holding means 74 and rod-like support legs 110 each held between holding means 74. The free end of respective support leg 110 is penetrated into rubber mat 94. In bass drum 80 so constructed, vibration produced on vibration plate 18 by a strike force applied by the striking member as set out above can exactly be picked up by sensor 24.

Since cushioning member 16, vibration plate 18 and cushioning plate 20 are held within mounting chassis 88 which is located at the center of front panel 84, they can be compactly configured as one unit in view of a relatively large outer dimension of the entire shell. During the assembly of bass drum 80, cushioning member 16, vibration plate 18 and cushioning plate 20 are initially inserted into mounting chassis 88; mounting chassis 88 is fitted into mounting hole 96 of front panel 84 supported by rear case 82; and mounting chassis 88 together with decorative ring 102 is attached to the front surface of front panel 84 by screws 108. Thus the assembling operation can readily be achieved in this embodiment. Since the beater as the striking member for bass drum 80 is equipped with a felt-covered tip, it never causes an injury to cushioning plate 20 which is exposed, unlike the aforementioned embodiment where cushioning plate 20 is covered with drumhead 80.

A first variant of the cushioning member is explained below for another embodiment of this invention by reference to FIG. 9. In this embodiment, the same reference numerals are employed to designate parts or elements corresponding to those shown in the embodiment of FIGS. 1 to 4. Further explanation is, therefore, omitted for brevity's sake.

Figure 9:
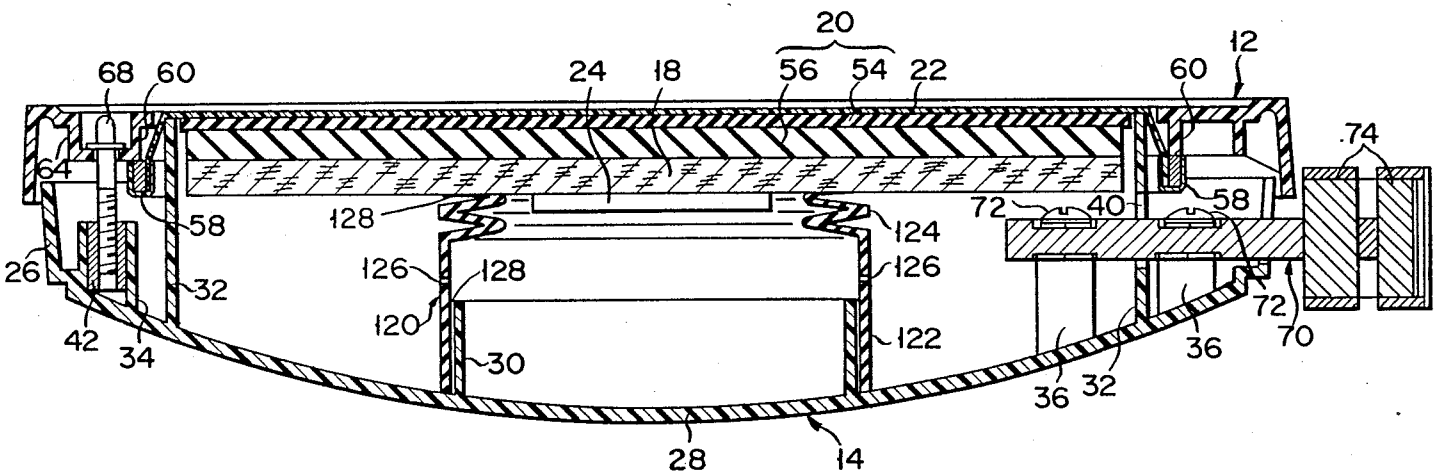
FIG. 9 is a diagrammatic, cross-sectional view showing a snare drum, similar to that of FIG. 1, showing a first modified form of the cushioning member.

In the embodiment shown in FIG. 9, cushioning member 120, like cushioning member 16 as shown in FIGS. 3 and 4, is comprised of elastically deforming cushioning section 122 of cylindrical configuration and outwardly urging bellows-like section 124 and a plurality of orifices 126 are provided in elastically deforming cushioning section 122 to allow air within elastically deforming cushioning section 122 to flow out in a restricted fashion. Elastically deforming cushioning section 122 of cushioning member 120 is intimately fitted over cushioning member attaching section 30 due to the presence of sealing agent 128, such as a grease. In this embodiment, the aforementioned sealing agent is also coated on that end face of outwardly urging section 124 of cushioning member 120 which contacts with vibration plate 18. The use of sealing agent 128 allows an outflow and inflow of air to be effected out of and into the interior spacing of cushioning member only through orifices 126. Upon comparison with snare drum 10 utilizing the elasticity of cushioning member 16 per se, the snare drum utilizing the elasticity of, and an air cushion within, cushioning member 16 enables the performer to enjoy nearly the same beating "touch" or "feel" during performance as the traditional acoustic drum.

Furthermore, even if exhaust and suction valves are provided at elastically deforming cushioning section 122 of cushioning member 120 in place of the aforementioned orifices, it is equally possible to obtain the same advantages as set forth above.

Figure 10:
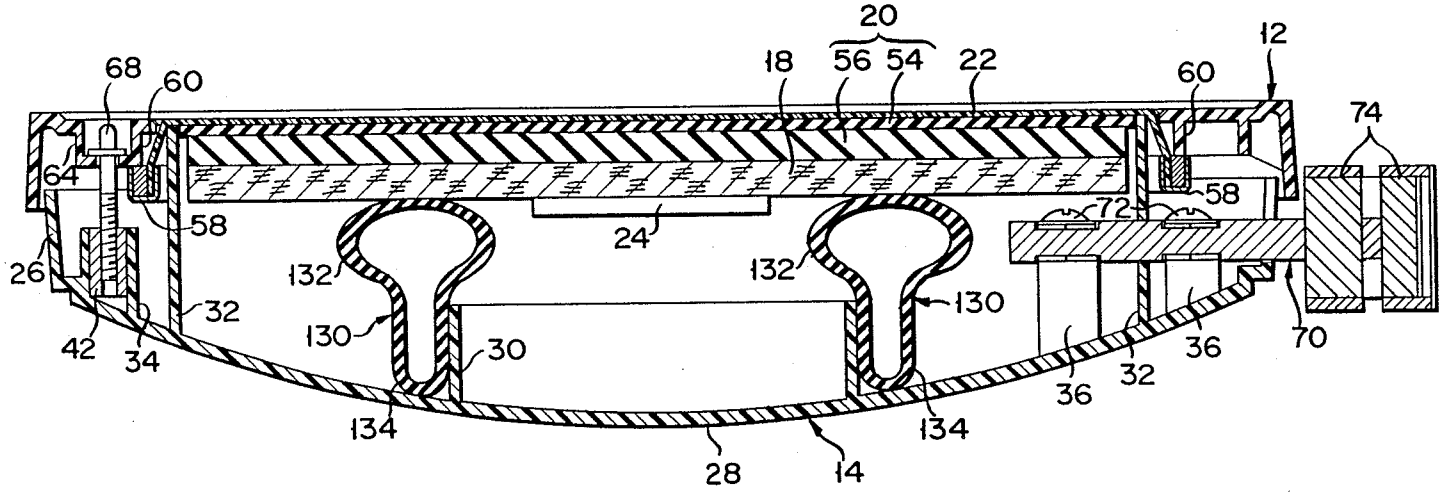
FIG. 10 is a diagrammatic, cross-sectional view showing a second modified form of the cushioning member.

FIG. 10 shows a snare drum according to another embodiment of this invention employing a second form of variant of the aforementioned cushioning member. In this embodiment, the same reference numerals are employed to designate parts or elements corresponding to those shown in the embodiment shown in FIGS. 1 to 4.

In the embodiment shown in FIG. 10, cushioning member 130 is comprised of a cushioning tube body of a ring-like configuration with air sealed therein at a predetermined pressure level. The cushioning body is substantially T-like in cross-section and is comprised of bulged section 132 contacting with vibration plate 18 to urge vibration plate 18 and cushioning plate 20 outwardly and positioning/holding section 134 which is elongated in cross-section and whose bottom abuts against the inner surface of bottom wall 38 of lower case 14. Positioning/holding section 134 of the cushioning body is fitted over cushioning member attaching section 30 of lower case 14 and serves to function as a positioning/holding section for positioning and holding cushioning section 130 in proper place over bottom wall 38 of lower case 14. When receiving a force exceeding a predetermined level, section 134 of the cushioning body is elastically deformed to accommodate such an excess strike force. It is, therefore, possible to obtain the same technical advantages as cushioning member 120 as shown in FIG. 9.

Although, in the aforementioned cushioning member, the outwardly urging section and elastically deforming cushioning section are formed integral to each other, it may be formed separate from each other in which case these associated members are connected together during assembly.

What is claimed is:

1. An electronic drum comprising:

a shell having an opening portion at one end and a closing portion the other end;

a strikable member adapted to be struck, said strikable member being located at said opening portion of said shell;

means for preventing said strikable member from coming out from said opening portion of said shell;

a cushioning member having a substantially cylindrical configuration and located within said shell and sandwiched between said strikable member and said closing portion of said shell, said cushioning member including a bellows-like urging section for urging said strikable member in a direction toward said opening portion of said shell and a cushioning section which is elastically deformable to allow said strikable member to move toward said closing portion of said shell when a force transmitted from said strikable member is larger than a predetermined value; and means, mounted within said cushioning member and on said strikable member, for picking up vibration of said strikable member which is produced when said strikable member is struck, and for generating an electrical signal corresponding to the vibration.

2. The electronic drum of claim 1, wherein said strikable member comprises a plate-like cushioning means for damping a strike force applied on said strikable member, and a vibration plate intimately attached to said cushioning means to be vibrated by a damped strike force transmitted through said cushioning means when the damped strike force is larger than said predetermined value and said cushioning section of said cushioning member is elastically deformed.

3. The electronic drum of claim 2, wherein said plate-like cushioning means includes a damping member for damping a strike force applied on said strikable member and a thin drumhead member covering an outer surface of said damping member.

4. The electronic drum of claim 3, wherein said damping member includes a first cushioning plate intimately contacting said drumhead member, and a second cushioning plate attached to said first cushioning plate and contacting said vibration plate, said second cushioning plate being made of an elastic material which is softer than the material from which said first cushioning plate is made.

5. The electronic drum of claim 1, wherein said elastically deformable cushioning section of said cushioning member has a cylindrical configuration and is fixed to said closing portion of said shell.

6. The electronic drum of claim 3, wherein said shell includes a cylindrical upper case portion having said opening portion therein, a bowl-like lower case portion defining said closing portion of said shell, and joining means for joining said upper case portion to an open end of said lower case portion.

7. The electronic drum of claim 6, wherein:

said upper case portion of said shell includes a first ring-like section protruding into an inner space of said lower case portion, and said lower case portion includes a second ring-like section located radially inside of said inwardly pressing ring-like section of said upper case portion; and said second ring-like section supports an outer peripheral edge portion of said drumhead member, and said first ring-like section presses inwardly on an outer peripheral portion of said drumhead member to spread out said drumhead member on said second ring-like section.

8. The electronic drum of claim 6, wherein said joining means includes bolts, one of said upper and lower case portions of said shell having insertion holes for receiving said bolts, and the other of said case portions having threaded insertion holes into which said bolts received in said insertion holes of said one case portion are threadably inserted.

9. The electronic drum of claim 8, wherein one of said upper and lower case portions includes bolt guides for guiding forward ends of each of said bolts, which has been inserted into said threaded insertion holes of said other case portion.

10. The electronic drum of claim 6, further comprising stand connection means, provided on said lower case portion, for connecting said electronic drum to a stand.

11. The electronic drum of claim 1, wherein said cushioning member contacts at one end thereof an inner surface of said strikable member in a hermetically sealed fashion, and another end of said cushioning member being fixed to an enclosed end of an inner surface of said shell in a hermetically sealed fashion.

12. The electronic drum of claim 11, further comprising orifices formed on an outer peripheral wall of said cushioning member to allow air in an inner space of said cushioning member to flow out in a restricted fashion.

13. An electronic drum comprising:

a shell having an opening portion at one end and a closing portion the other end;

a front panel fixed at said opening portion of said shell, said front panel having a central opening portion at its center;

a cylindrical mounting chassis having two ends, one end being fixed to said central opening portion to locate the other end thereof within said shell, said mounting chassis having an inner space and an outer opening communicating with said inner space;

a strikable member adapted to be struck, said strikable member being located in said inner space of said mounting chassis;

means for preventing said strikable member from coming out from said outer opening of said inner space of said mounting chassis, said outer opening of said mounting chassis being located near said opening portion at said one end of said shell;

a cushioning member having a substantially cylindrical configuration and held within said inner space of said mounting chassis at a position nearer to said closing portion of said shell than to said strikable member, said cushioning member including an urging section for urging said strikable member in a direction toward said outer opening of said inner space of said mounting chassis, and an elastically deformable cushioning section which is elastically deformable to allow said strikable member to move toward said closing portion of said shell when a force transmitted from said strikable member to said cushioning member is larger than a predetermined value; and means, attached to said strikable member, for picking up vibration of said strikable member which is produced when said strikable member is struck, and for generating an electrical signal corresponding to the vibration.

14. The electronic drum of claim 13, wherein said strikable member comprises a plate-like cushioning means for damping a strike force applied on said strikable member, and a vibration plate intimately attached to said cushioning means to be vibrated by a damped strike force transmitted through said cushioning means when the damped strike force is larger than said predetermined value and said cushioning section of said cushioning member is elastically deformed.

15. The electronic drum of claim 13, wherein said preventing means includes:

a press-down section for pressing down a peripheral edge of an outer surface of said strikable member in an axial direction of said mounting chassis to sandwich said strikable member between said press-down section and said cushioning member; and a flange integrally formed with said press-down section and fixed to said front panel.

16. The electronic drum of claim 15, wherein said cushioning means includes a first cushioning sheet engaging at a peripheral edge of its outer surface with said press-down section of said preventing means, and a second cushioning sheet attached to an inner surface of said first cushioning sheet and intimately contacting said vibration plate, said second cushioning sheet being made of an elastic material which is softer than the material from which said first cushioning sheet is made.

17. The electronic drum of claim 13, wherein said urging section of said cushioning member has a bellows-like configuration to permit it to elastically expand and contract in an axial direction and to contact said strikable member.

18. The electronic drum of claim 13, wherein:

said elastically deformable cushioning section of said cushioning member has a cylindrical configuration; and said mounting chassis includes a cushioning member attaching section on an inner surface of said mounting chassis, and to which said elastically deformable cushioning section is attached.

19. The electronic drum of claim 13, wherein said shell comprises a front panel having said opening of said shell therein; and a substantially cup-like rear plate panel defining said closed end of said shell; said cup-like rear plate panel having an open end which is fixed to said front panel.

20. The electronic drum of claim 19, wherein the opening of said shell is formed at a substantially central portion of said front panel.

21. The electronic drum of claim 20, wherein said mounting chassis is of a substantially cylindrical configuration and has a fixing section at one end thereof which is fixed to an outer surface of said front panel, and a cushioning member attaching section at another end thereof for holding said elastically deformable cushioning section of said cushioning member.

22. The electronic drum of claim 19, further comprising front panel support leg means attached to an outer peripheral portion of said front panel for supporting said front panel; and rear case support leg means provided on said rear plate panel for supporting said rear plate panel.

23. An electronic drum comprising:

a drum shell having an opening portion at one end and a closing portion at the other end;

a strikable member adapted to be struck, said strikable member being located at said opening portion of said drum shell;

means for preventing said strikable member from coming out from said opening of said drum shell;

a cushioning member having a substantially cylindrical configuration and located within said drum shell and sandwiched between said strikable member and said closing portion of said drum shell in a compressed manner and sealingly holding a gas in an inner space thereof, said cushioning member including an urging section for urging said strikable member in a direction toward said opening portion of said drum shell, and a cushioning section which is elastically deformable to allow said strikable member to move toward said closing portion of said drum shell when a force transmitted from said strikable member to said cushioning member is larger than a predetermined value; and means, mounted on said strikable member, for picking up vibration of said strikable member which is produced when said strikable member is struck, and for generating an electrical signal corresponding to the vibration.

24. The electronic drum of claim 23, wherein said cushioning member has a closed end, a ring-like configuration with a substantially T-shaped cross section and an inner space which also has a substantially T-shaped cross section, said urging section of said cushioning member including a cross bar portion having a top flat surface and which intimately contacts at its top flat surface said strikable member, and a vertically extending bar portion of said cushioning member comprising said cushioning section and a free end of which contacts an inner surface of a closed end of said ring-like cushioning member.

25. The electronic drum of claim 24, further comprising a cushioning section attaching section having a cylindrical shape on an inner surface of said closing portion of said drum shell and which is engaged with a free end of said cushioning section of said cushioning member for attaching said cushioning section to an inner surface of said closing portion.

* * * * *